US006511559B2

(12) United States Patent
Brenner et al.

(10) Patent No.: US 6,511,559 B2
(45) Date of Patent: Jan. 28, 2003

(54) PROCESS FOR PRODUCING WEAR-RESISTANT EDGE LAYERS IN PRECIPITATION-HARDENABLE MATERIALS

(75) Inventors: Berndt Brenner, Pappritz (DE); Frank Tietz, Dresden (DE)

(73) Assignee: Fraunhofer-Geselleschaft zur Foerderung der angewandten Forschung e.V., Munich (DE)

( * ) Notice: Subject to any disclaimer, the term of this patent is extended or adjusted under 35 U.S.C. 154(b) by 40 days.

(21) Appl. No.: 09/736,443

(22) Filed: Dec. 15, 2000

(65) Prior Publication Data

US 2002/0074066 A1 Jun. 20, 2002

(51) Int. Cl.[7] ..... C21D 1/68; C21D 1/09

(52) U.S. Cl. ..... 148/639; 148/525; 148/526; 148/902

(58) Field of Search ..... 148/639, 902, 148/525, 526

(56) References Cited

U.S. PATENT DOCUMENTS 3,660,176 A 5/1972 Denhard, Jr.
5,238,510 A * 8/1993 Dutton et al. ..... 148/639

OTHER PUBLICATIONS

Brochure of the company Böhler Edelstahl GmbH (Kapfenberg, Austria) about the steel N700 (publication date:1996 or earlier).

* cited by examiner

*Primary Examiner*—Sikyin Ip
(74) *Attorney, Agent, or Firm*—Greenblum & Bernstein, P.L.C.

(57) ABSTRACT

A process for producing wear-resistant edge layers in precipitation-hardenable materials wherein a component that was conventionally solution annealed and subsequently subjected to a conventional aging heat treatment is subjected to another short-time solution annealing affecting only the edge layer of the component, whereafter another aging heat treatment that evenly includes the interior of the component and its edge layer is carried out.

14 Claims, 2 Drawing Sheets

PROCESS FOR PRODUCING WEAR-RESISTANT EDGE LAYERS IN PRECIPITATION-HARDENABLE MATERIALS

CROSS-REFERENCE TO RELATED APPLICATIONS

The present application is directed to subject matter of German Patent Application No. 199 28 773.2, filed on Jun. 23, 1999, the disclosure of which is expressly incorporated by reference herein in its entirety.

BACKGROUND OF THE INVENTION

1. Field of the Invention

The invention relates to the hardening of edge layers of machine components. Objects for which utilization is practical and useful are components that are heavily exposed to wear and fatigue that are produced from precipitation-hardenable materials because of the high demands in material strength with, at the same time, high toughness. The invention may be used particularly advantageously for increasing the wear resistance of components made from stainless, precipitation-hardenable martensic steel, such as, e.g., turbine buckets, pump shafts, highly stressed bolts in aeronautics, components in shipbuilding, or special tools. An additional area of use is components exposed to wear made from high duty martensite hardening (Maraging) steel that cannot be used in a fully hardened state when high demands of toughness are present.

2. Discussion of Background Information

During use, edge zones of components placed under wear and fatigue stresses are exposed to significantly different stress than the core of the component. This fact is known to be considered in producing in the edge zone a harder, more wear or fatigue resistant structure using thermal, physical, chemical, mechanical, thermodynamical, or thermomechanical procedures as compared to the core, whose structure is adjusted such that it primarily meets the present demands in hardening and toughness.

This background of the invention shall be explained in greater detail using a characteristic component, prototypically chosen, without limiting its general purpose. Rotating blades of low-pressure stages in steam turbines are exposed during their use to extremely high pseudostatic (centrifugal forces, blade torsion), cyclic stresses (periodic exposure to steam pressure, blade oscillations), and tribologic (impingement) loading. In particular, the constant impact of condensed water droplets leads to an eroding wear in the area of the leading edge of the blade. Martensite-hardened 13% steels are able to meet these complex demands. Here, the blade material is used in the hardened, tempered state (meeting the requirements in toughness, stress corrosion resistance, corrosion fatigue resistance, sufficient static and cyclic stress resistance; hardness about 250–350 Vickers hardness numbers (VHN)) and the area of the leading edge of the blade is short-time hardened, e.g., via flame, induction, or laser hardening (very high resistance to wear by impingement, 390–680 HV). Increasing requirements in static and cyclic working stress as well as resistance to stress corrosion or corrosion fatigue have lately lead to the use of non-corroding precipitation-hardenable martensitic steel. In relation to tempered steel, they do not receive the biggest part of the increase in hardening and toughness by the formation of martensite but by a controlled precipitation hardening.

For this purpose, the steel contains 10–20 wt-% chrome and 2–11 wt-% nickel, usually copper (1–5 wt-%), and aluminum, titanium, or niobium as a precipitation former. In turbine constructions, a typical representative of this type of steel is the steel X5CrNiCuNb16-4. The heat treatment usually contains at least one solution annealing at 1030–1080° C. (duration of approximately 1 h.) and the precipitation treatment per se in the temperature range between 480° C. and 620° C. (duration 1–4 hs.) The achievable mechanical characteristics, hardening, yielding stress $R_{p0.2}$ and tensile strength $R_m$, reach their maximum at the lower limit of conventionally possible tempering temperature of 480° C. and diminish drastically in increasing aging temperature (see Drawing 1). For instance, in the temperature range of 480–620° C., the hardening drops from 425 HV to 285 HV, the yielding level from 1170 to 750 MPa, and the tensile strength from 1310 to 930 MPa. Due to the required toughness levels, resistance against stress corrosion, and corrosion fatigue, the tempering temperature must be chosen that high that the 0.2% yielding level remains below 1040 and the tensile strength below 1000 MPa. This means that the low range of the possible tempering temperature producing the high velocities cannot be used (see Drawing 1).

Therefore, the shortcoming of this conventional heat treatment process lies in the resistance to wear from impingement being too low. This is based on the hardening of 340–370 HV being too low near the surface.

It is known that the surface hardening of precipitation-hardenable steel can be increased by plasma-nitriding up to about 1000 HV [e.g., brochure of the company Böhler Edelstahl GmbH (Kapfenberg, Austria) about the steel N700.] The shortcoming of this process includes that no improved resistance to impingement is achieved here, either. This shortcoming is based, e.g., on the fact that the achievable depth of nitriding of about 0.15 mm is much too low.

Other processes for tempering edge layers are not suitable either, since they affect the necessary aging treatment impermissibly or the achievable increase in hardness or the depth of the hardness is too low.

For improving the condition of the material itself, a process has become known in which a structure with a higher 0.2% yielding tension and tensile strength is achieved by coupling a short-time tempering with a conventional tempering treatment [see E. E. Denhard, Jr.: "Precipitation-hardenable stainless steel method and product," U.S. Pat. No. 3,660,176.] For this purpose, the entire partially-finished product is exposed to a thorough short-time heating in the temperature range between 816° C. and 1149° C. of the solution annealing treatment within a time frame of 1 to 15 seconds by a direct flow of current and rapidly cooled. Then a conventional tempering treatment occurs in the conventionally used temperature range. It is thus possible, with a solutions annealing temperature of 1149° C., a solution annealing time of 2 seconds, a tempering temperature of 482° C., and a tempering time of 1 hour, to raise the 0.2% yielding level from 1328 MPa to 1695 MPa and the tensile strength from 1378 MPa to 1700 MPa. The achieved hardness is not listed.

The shortcoming of this process is that it is not suitable for being used in components of complex forms such as turbine buckets. This shortcoming is caused by the heating measures being used, such as conductive or inductive heating, depending on geometric relationships.

Another essential shortcoming is the fact that the tougness and endurance range and, in particular, the resistance against stress corrosion and corrosion fatigue of a turbine bucket treated in this manner would be too low. The reason for this lies in the hardness of the interior of the blade being much too strong. If the turbine bucket were to be tempered at higher temperatures, however, the hardness in the area of the leading edge of the bucket would be too low. With this process for improving the state of the material itself, it is not possible to simultaneously accommodate the different requirements that are placed upon the edge layer and the core of the component.

Another shortcoming lies in the fact that a conventional performance of tempering hardening cannot utilize the capacity for hardening in the state of the short-time solution annealing completely. This is caused by two facts: first, higher hardening states of structure that contain the entire cross-section of the component cannot be used due to low toughness, and second, new metal-physical degrees of freedom that offer short-time solution annealing for subsequent tempering hardening are not known.

SUMMARY OF THE INVENTION

The object of the invention is to provide a new and effective heat treatment process that allows components of precipitation-hardenable materials to be provided with considerably better wear-resistant edge layers without having to accept a worsening of the remaining mechanical properties of the component.

The object of the invention is to provide a heat treatment process that allows a stronger hardness of the edge layers up to a sufficient depth with sufficient toughness to be achieved, depending on the tribological loading, independent of the structure and the mechanical characteristics of the component core, and without influencing them, which can also be used in components of complicated shapes and in which the tempering temperature better utilizes the hardening capabilities of the short-time solution annealing.

This object is attained according to the invention with a process for creating wear-resistant edge layers in precipitation-hardenable materials as described hereinbelow.

In the process of the invention for producing wear-resistant edge layers in precipitation-hardenable materials by means of a short-time solution annealing and a subsequent aging heat treatment a component that was conventionally solution annealed at a temperature $T_{csa1}$ and subsequently subjected to a conventional aging heat treatment at a temperature $T_{cpa1}$ is subjected to another short-time solution annealing affecting only the edge layer of the component at a temperature $T_{ssa}>T_{csa1}$ and a duration of the short-time solution annealing $\Delta t_{ssa}<12$ s. Subsequently another aging heat treatment is performed that evenly includes the interior of the component and its edge layer at a temperature $T_{spa}<T_{cpa1}$. In one aspect of this process, the edge layer of the component up to a depth $t_H$ that corresponds to the desired hardening depth is solution annealed by means of a short-time energy impact originating in the surface of the component; the short-time energy impact originating in the surface of the component is achieved by means of a high-energy edge surface heating process; the heating speed $(\Delta T/\Delta t)_{ssh}$ reaches values of $10^2$ K/s$\leqq(\Delta T/\Delta t)_{ssh}\leqq 10^4$ K/s; the temperature gradient $(\Delta T/\Delta r)_{ssh}$ is selected in the range of 13 K/mm$\leqq(\Delta T/\Delta r)_{ssh}\leqq$1000 K/mm; $T_{csa2}$+50 K$\leqq T_{max\ ssa}\leqq T_{csa2}$+400 K applies as the peak temperature of the short-time solution annealing treatment $T_{max\ ssa}$, with $T_{csa2}$ being the conventional solution annealing temperature of the corresponding material; the duration of the short-time solution annealing $\Delta t_{ssa}$ in the temperature range in which a noticeable dissolution of the precipitations occurs lies in the range of $10^{-1}$ s$\leqq\Delta t_{ssa}\leqq$12 s; the cooling speed $(\Delta T/\Delta t)_{ssc}$ attains maximum values in the cooling cycle of 5 K/s$\leqq(\Delta T/\Delta t)_{ssc}\leqq 10^4$ K/s; the aging heat treatment is performed with a longer duration as compared to the short-time solution annealing $\Delta t_{spa}$, $\Delta t_{spa}>\Delta t_{ssh}$ and with a significantly lower temperature gradient $(\Delta T/\Delta r)_{spa}$, $(\Delta T/\Delta r)_{spa}<<(\Delta T/\Delta r)_{ssh}$; $T_{spa}\leqq T_{cpa2}\leqq T_{spa}$+80 K applies as the temperature $T_{spa}$ of the aging heat treatment, with $T_{cpa2}$ being the lower limit of the conventional temperature range for the aging heat treatment; and the duration of the aging heat treatment $\Delta t_{spa}$ is one and a half to sixteen times as long as the holding time $\Delta t_{cpa2}$ of a conventional aging heat treatment. The process is based on functional optimizing by separately adjusting the structure in the component core and the edge layer. Here, the state of the structure in the component core as well as the core strength and toughness resulting therefrom are adjusted by means of a previous conventional heat treatment. Then the solution tempering of the edge layers occurs in a highly inhomogeneous temperature field, followed by an annealing process of the entire component, modified according to the invention, in a homogeneous or almost homogeneous temperature field. The requirements in depth, width, position, and progression of the wear protection zone, resulting from the analysis of the tribological loading and/or cyclic distribution of stress, are equivalent to the desired geometry of the solution annealing zone. The solution annealing zone is created by an edge layer heating process with a sufficient power density. The depth $t_H$ of the desired solution annealing zone is adjusted by the locally absorbing energy density and the local energy impact duration. The energy density and the energy impact duration also control the resulting heating speed $(\Delta T/\Delta t)_{ssh}$ and the temperature gradients $(\Delta T/\Delta r)_{ssh}$.

The selection of the two parameters as well as the duration $\Delta t_{ssa}$ and the peak temperature $T_{max\ ssa}$ of the short-time solution annealing within the predetermined data range ensures a sufficiently quick dissolution of the precipitation without the danger of coarser grain. Dependent on the peak temperature $T_{max\ ssa}$ and the original structure and the chemical composition of the component the cooling speed $(\Delta T/\Delta t)_{ssc}$ according to the invention prevents coarser grain during the cooling process and an uncontrolled precipitation hardening. The determination of the unusually high amount for the maximal temperature peak $T_{max\ ssa}$ utilizes the knowledge that the hardness of the edge layer being the main parameter determining the wear resistance in coordinating wear types increases with rising temperature or decreases only little. This way even in greater depths a solution state of precipitations can be achieved that ensures a stronger hardening depth or a slower hardening decrease. A specific embodiment of the invention for the classes of martensitic precipitation-hardenable steels comprises performing the edge surface processing of precipitation-hardenable steels with carbon contents of 0.03 to 0.08 weight-%, chrome contents of 10 to 19 weight-%, nickel contents of 3.0 to 11.0 weight-%, copper contents of 1.0 to 5.0 weight-%, and niobium contents of 0.15 to 0.45 weight-% in such a way that the depth $t_H$ of the solution annealed edge layer is 0.1 mm$\leqq t_H\leqq$7 mm; 1080° C.$\leqq T_{max\ ssa}\leqq$1350° C. applies as the peak temperature $T_{max\ ssa}$ of the short-time solution annealing; the temperature $T_{spa}$ of the aging heat treatment is selected in the range of 445° C.$\leqq T_{spa}\leqq$500° C.; and the duration of the aging heat treatment $\Delta t_{spa}$ is set in the range of 1 h$\leqq\Delta t_{spa}\leqq$8 h. By choosing the parameters according to the invention for the peak temperature $T_{max\ ssa}$, the temperature $T_{spa}$ and the time $\Delta t_{spa}$, a significantly stronger edge layer hardness is achieved.

The embodiment of the process of the present invention wherein after the short-time solution annealing treatment and before the aging heat treatment, a mechanical deformation of the edge layer is performed, is advantageous in that it can improve the state of the internal stress of the precipitation-hardened edge layer and in that a larger amount of nucleation sites for the formation of fine precipitations is available.

It is particularly advantageous when the process steps of short-time precipitation annealing, mechanical deformation, and precipitation heat treatment are combined in the processing of partially finished products where these partially finished products receive their final form by means of a deformation and/or where the short-time solution annealing treatment, the deformation, and the aging heat treatment take place in a continuous process.

The embodiment wherein the mechanical deformation of the edge layer is performed by means of shot peening with steel balls can be used particularly advantageously for the optimizing of the edge layer characteristics of very complicatedly shaped or very locally treated components such as turbine buckets.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
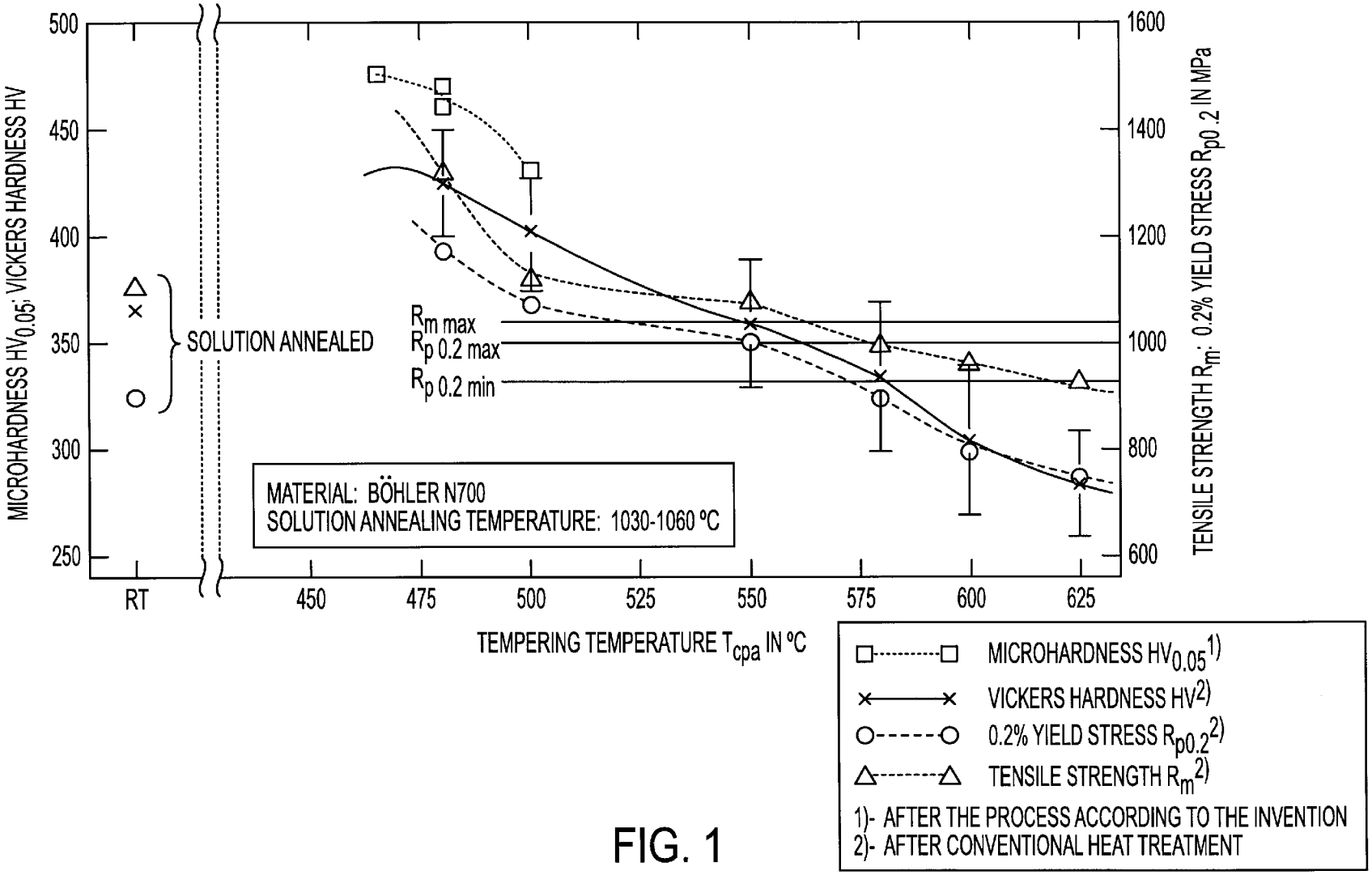
FIG. 1 illustrates the dependency of the mechanical characteristic values of Vickers hardness HV, 0.2% yield stress (limit of elasticity) $R_{p0.2}$, and tensile strength $R_m$ after conventional heat treatment as well as the microhardness after the heat treatment according to the invention dependent upon the tempering temperature $T_{cpa}$.
Figure 2:
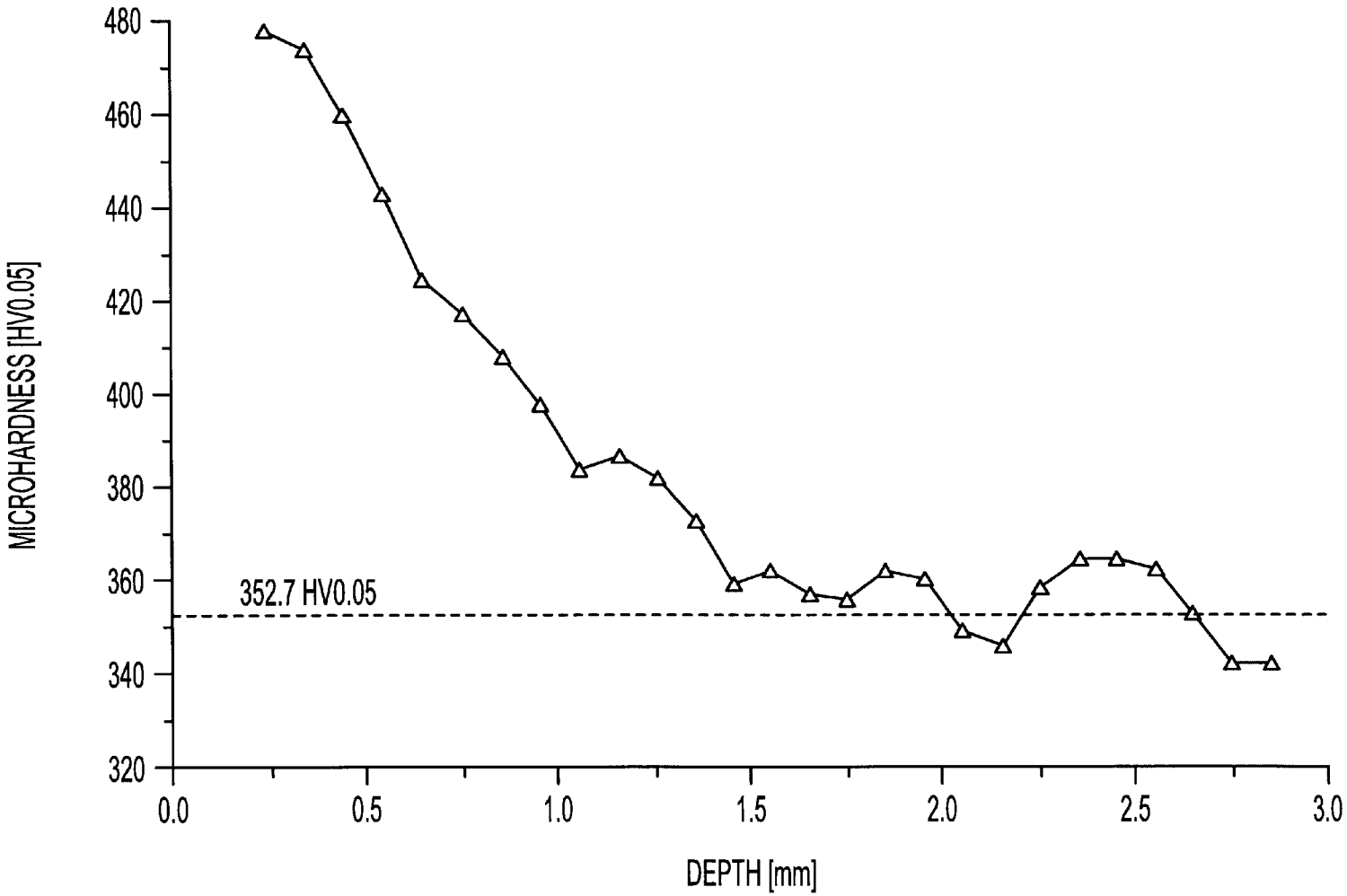
FIG. 2 illustrates the hardness depth relationship of the material Böhler N700 that has been heat treated according to the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The heat treatment according to the invention can be used for different classes of steel (stainless and acid-resistant steel, tool steel, special steels) and steel. Such steels are, e.g., X5CrNiCuNb16-4 (1.4542); X2NiCoMo18-8-5 (1.6359); X2NiCoMo18-12 (1.6355); X1CrNiCoMo13-8-5 (1.6960); 17-7 PH; 17-4 PH; 15-5 PH; 17-7 B; PH 13-8Mo; PH 12-9Mo, etc.

Without limiting its general validity, the invention shall be explained using the example of a complicatedly shaped, highly stressed component made of steel X5CrNiCuNb16-4, as follows:

EXAMPLE

A low-pressure stage turbine blade made of steel N700 (product name of Böhler Edelstahl GmbH Kaptenberg, Austria), exposed to impingement, is to be provided with a wear-resistant leading edge. The width of the erosion loaded area is expected to be 11 mm. The erosion intensity is highest at the leading edge and reduces quickly within the erosion zone width in the direction of the blade outlet edge. In the proximity of the leading edge, 1.3 mm are desired as the maximal hardening depth $t_H$ of the edge layer with the hardening depth being allowed to diminish according to the reduction of the erosion intensity with the growing distance from the leading edge.

The material N700 has the following desired chemical composition: carbon ≦0.04%; silicon: 0.25%; manganese: 0.40%; chrome: 15.40%; nickel: 4.40%; copper: 3.30%; niobium: 0.30% (each value in percent by weight.) In order to ensure the mechanical and cyclic stress resistance of the rotating blade to centrifugal force and steam force exposure, torsion, etc., the following mechanical parameters are adjusted by means of a conventional heat treatment: 0.2% yielding level $R_{p0.2}$: 930–1000 MPa, tensile strength $R_m$≦1040 MPa (see dot-dash fields in drawing 1). Here, the solution tempering treatment is performed at a temperature of $T_{csa1}$=1030–1060° C. for a duration of Δt=1 h. The precipitation heat treatment occurs at a temperature of $T_{cpa1}$=540° C.–570° C. for a duration of $\Delta t_{cpa1}$=4 h. Cooling occurs by air. The developing microhardness is 353 $HV_{0.05}$ and, in the core of the component, is equal to the edge layer. This level of hardness is insufficient for the necessary droplet wear resistance.

The heat treatment for creating wear resistant edge layers according to the invention is performed as follows:

The short-time solution tempering treatment is performed with a $CO_2$ laser. For this purpose, the turbine blade is fastened in the blade clamp of a 6 axis CNC machine and is passed underneath the laser beam at a driving speed dependent on the distance from the blade tip and simultaneously rotated. The laser beam forming system includes an off-axis parabolic mirror with a focal distance f=300 mm. The zone to be solution tempered is covered with an absorption material of 100 μm thickness for increasing the absorption of the $CO_2$ laser beams. A so-called extended pigment paint with a high content of filler material is used as the absorption material. The parameters for the laser beam treatment are selected as follows:

- laser beam output at the point of impact of the laser beam: 2.75 kW;
- absorbed laser beam output: 2.2 kW
- driving speed: 1000 mm/min;
- diameter of the beam spot: 11.9 mm;
- resulting average laser output density: 2.0 kW/cm$^2$.

This set of radiation parameters results in the following parameters of the short-time solution tempering:

- heating speed $(\Delta T/\Delta t)_{ssh}$≅2300 K/s;
- temperature gradient for heating (at a greater distance from the blade tip) $(\Delta T/\Delta r)_{ssh}$≅360 K/mm;
- peak temperature $T_{max\ ssa}$≅1350° C.;
- duration period of the short-time solution tempering $\Delta t_{ssa}$≅0.7 s;
- cooling speed $(\Delta T/\Delta t)_{sec}$≅600 K/s.

The temperature $T_{csa2}$ and the duration $\Delta t_{csa2}$ of the conventional solution tempering treatment for comparison were at $T_{csa2}$≈1050° C. and $\Delta t_{ssa}$≈1 h. That proves: $T_{csa2}$+300 K=$T_{max\ ssa}$.

After the cooling process, internal tensile stress exist in the solution tempered zone. Additionally, the absorption material must be removed. The removal of the absorption material occurs by a treatment of shot peening with steel balls. This simultaneously ensures the reduction of the internal residual tensile stresses and the creation of internal residual compressive stresses, some of which even remain after the precipitation heat treatment.

The subsequent precipitation heat treatment occurs with the following parameters:

precipitation temperature $T_{spa} \cong 465°$ C., precipitation duration $\Delta t_{spa} \cong 4$ h.

The temperatures $T_{cpa2}$ and the duration $\Delta t_{cpa2}$ of the conventional solution tempering treatment for comparison were at $T_{cpa2}=480°$ C. and $\Delta t_{cpa2}=1$ h.

That proves $T_{spa}+15\ K=T_{cpa2}$; $\Delta t_{spa}=4*\Delta t_{cpa2}$:

The heating occurs effectively in a conventional heat treatment oven using nitrogen as the protective gas.

Drawing 2 depicts the edge layer hardening $HV_{0.05}$ achieved and the hardness-depth relationship. The floating average of 5 microhardness impressions is listed for each. The edge layer hardness reaches 477 $HV_{0.05}$. This is an increase in hardness of 124 $HV_{0.05}$ The hardening depth up to the hardening limit of 353 HV is 1.5 mm. With this, a considerably improved wear resistance can be expected without any essential loss of toughness of the blade. The internal compression residual stress state achieved reduces in the hardened zone the susceptibility to stress corrosion and corrosion fatigue in the hardened structure.

The dependency of the microhardness $HV_{0.05}$ on the edge layer produced according to the invention from the precipitation temperature is described by way of comparison in drawing 1. It is discernible that the microhardness values in the precipitation temperature range 460° C.$\leqq T_{spa} \leqq$510° C. are significantly higher than those of the conventional heat treatment.

List of abbreviations and symbols used:

| | |
|---|---|
| $T_{maxss0}$ | peak temperature of the short-time solution annealing |
| $T_{csa1}$ | temperature of the conventional solution annealing for adjusting the original structure in the component core |
| $T_{csa2}$ | temperature of the conventional solution annealing for comparison |
| $\Delta t_{ss0}$ | duration of the short-time solution annealing |
| $\Delta t_{csa1}$ | duration of the conventional solution annealing for adjusting the original structure in the component core |
| $\Delta t_{csa2}$ | duration of the conventional solution annealing for comparison |
| $(\Delta T/\Delta t)_{ssh}$ | average heating speed for achieving the peak temperature of the short-time solution annealing |
| $(\Delta T/\Delta t)_{ssc}$ | (temperature and duration dependent) cooling speed from temperature $T_{maxssa}$ of the short-time solution annealing |
| $(\Delta T/\Delta r)_{ssh}$ | temperature gradient of the temperature field of the short-time solution annealing during the heating process |
| $T_{spa}$ | temperature of the precipitation annealing treatment according to the invention |
| $T_{cpa1}$ | temperature of the conventional precipitation annealing treatment for adjusting the initiai structure in the component core |
| $T_{cpa2}$ | temperature of the conventional precipitation annealing treatment for comparison |
| $\Delta t_{spa}$ | duration of the precipitation annealing treatment according to the invention |
| $\Delta t_{cpa1}$ | duration of the conventional precipitation annealing treatment for adjustment of the original structures in the component core |
| $\Delta t_{cpa2}$ | duration of the conventional precipitation annealing treatment for comparison |
| $(\Delta T/\Delta t)_{spa}$ | temperature gradient of the temperature field of the precipitation annealing greatment according to the invention |
| $t_H$ | hardening depth |
| $HV_{0.05}$ | microhardness at 50 p load |

-continued

| | |
|---|---|
| HV | Macro-Vickers-hardness |
| $R_{po2}$ | 0.2% yield limit |
| $R_m$ | tensile strength |

What is claimed is:

1. A process for producing wear-resistant edge layers in precipitation-hardenable materials by means of a short-time solution annealing and a subsequent aging heat treatment, wherein a component that was conventionally solution annealed at a temperature $T_{csa1}$ and subsequently subjected to a conventional aging heat treatment at a temperature $T_{cpa1}$ is subjected to another short-time solution annealing affecting only an edge layer of the component at a temperature $T_{ssa}>T_{csa1}$ and a duration of the short-time solution annealing $\Delta t_{ssa}<12$ s, whereafter another aging heat treatment is performed that evenly includes an interior of the component and its edge layer at a temperature $T_{spa}<T_{cpa1}$.

2. The process of claim 1, wherein a) the edge layer of the component up to a depth $t_H$, that corresponds to the desired hardening depth is solution annealed by means of a short-time energy impact originating in a surface of the component, b) the short-time energy impact originating in the surface of the component is achieved by means of a high-energy edge surface heating process, c) a heating speed $(\Delta T/\Delta t)_{ssh}$ reaches values of $10^2$ K/s$\leqq(\Delta T/\Delta t)_{ssh}\leqq 10^4$ K/s, d) a temperature gradient $(\Delta T/\Delta r)_{ssh}$ is selected in the range of 13 K/mm$\leqq(\Delta T/\Delta r)_{ssh}\leqq$1000 K/mm, e) $T_{csa2}+50\ K\leqq T_{max\ ssa}\leqq T_{csa2}+400$ K applies as a peak temperature of the short-time solution annealing treatment $T_{max\ ssa}$, with $T_{csa2}$ being a conventional solution annealing temperature of the corresponding material, f) the duration of the short-time solution annealing $\Delta t_{ssa}$ in the temperature range in which a noticeable dissolution of the precipitations occurs lies in the range of $10^{-1}$ s$\leqq\Delta t_{ssa}\leqq$12 s, g) a cooling speed $(\Delta T/\Delta t)_{ssc}$ attains maximum values in the cooling cycle of 5 K/s$\leqq(\Delta T/\Delta t)_{ssc}\leqq 10^4$ K/s, h) the aging heat treatment is performed with a longer duration as compared to the short-time solution annealing $\Delta t_{spa}$, $\Delta t_{spa}>\Delta t_{ssh}$ and with a significantly lower temperature gradient $(\Delta T/\Delta r)_{spa}$, $(\Delta T/\Delta r)_{spa}<<(\Delta T/\Delta r)_{ssh}$, i) $T_{spa}\leqq T_{cpa2}\leqq T_{spa}+80$ K applies as a temperature $T_{spa}$ of the aging heat treatment, with $T_{cpa2}$ being a lower limit of a conventional temperature range for aging heat treatment, j) a duration of the aging heat treatment $\Delta t_{spa}$ is one and a half to sixteen times as long as the holding time $\Delta t_{cpa2}$ of a conventional aging heat treatment.

3. The process of claim 1, wherein, as an initial state for the short-time solution annealing and the subsequent aging heat treatment, a precipitation-hardened material condition is selected whose mechanical characteristic values 0.2% yielding level, tensile strength, and hardness are selected in accordance with the demands placed on the component and are adjusted by means of the aging temperature $T_{cpa1}$ and an aging time $\Delta t_{cpa1}$.

4. The process according to claim 1, wherein the edge surface processing of precipitation-hardenable steels with carbon contents of 0.03 to 0.08 weight-%, chrome contents of 10 to 19 weight-%, nickel contents of 3.0 to 11.0 weight-%, copper contents of 1.0 to 5.0 weight-%, and niobium contents of 0.15 to 0.45 weight-% is performed in such a way that a) a depth $t_H$ of the solution annealed edge layer is 0.1 mm$\leqq t_H \leqq$7 mm, b) 1080° C.$\leqq T_{max\ ssa} \leqq$1350° C. applies as a peak temperature $T_{max\ ssa}$ of the short-time solution annealing, c) the temperature $T_{spa}$ of the aging heat treatment is selected in a range of 445° C.$\leqq T_{spa} \leqq$500° C., d) a duration of the aging heat treatment $\Delta t_{spa}$ is set in a range of 1 h$\leqq \Delta t_{spa} \leqq$8 h.

5. The process of claim 2, wherein the high-energy edge layer heating process is laser beam heating.

6. The process of claim 2, wherein the high-energy edge layer heating process is electron beam heating.

7. The process of claim 2, wherein the high-energy edge layer heating process is inductive edge layer heating.

8. The process of claim 2, wherein the cooling speed $(\Delta T/\Delta t)_{ssc}$ is achieved by means of an external cooling.

9. The process of claim 2, wherein the cooling speed $(\Delta T/\Delta t)_{ssc}$ is achieved by means of a rapid self-cooling.

10. The process of claim 1, wherein, after the short-time solution annealing treatment and before the aging heat treatment, a mechanical deformation of the edge layer is performed.

11. The process of claim 10, wherein the component is a partially finished product and the partially finished product receives its final form by means of a deformation.

12. The process of claim 10, wherein the short-time solution annealing treatment, the deformation, and the aging heat treatment take place in a continuous process.

13. The process of claim 10, wherein the mechanical deformation of the edge layer is performed by means of a shot peening.

14. The process of claim 1, wherein a temperature gradient $(\Delta T/\Delta r)_{ssh}$ for large components is selected in a range of 13 K/mm$\leqq(\Delta T/\Delta r)_{ssh} \leqq$400 K/mm.

* * * * *